US005194728A

United States Patent [19]

Peterson

[11] Patent Number: 5,194,728

[45] Date of Patent: Mar. 16, 1993

[54] CIRCUIT FOR DETECTING FIRING OF AN ULTRAVIOLET RADIATION DETECTOR TUBE

[75] Inventor: Scott M. Peterson, Eden Praire, Minn.

[73] Assignee: Honeywell Inc., Minneapolis, Minn.

[21] Appl. No.: 803,238

[22] Filed: Dec. 5, 1991

[51] Int. Cl.[5] ..... H01J 40/14

[52] U.S. Cl. ..... 250/214 R; 250/372; 250/554

[58] Field of Search ..... 250/365, 372, 214 R, 250/213 R, 213 VT, 554; 307/311; 340/578, 579; 315/150

[56] References Cited

U.S. PATENT DOCUMENTS

| | | | |
|---|---|---|---|
| Re. 29,143 | 2/1977 | Bianchini | 361/175 |
| 3,914,662 | 10/1975 | Bianchini | 317/124 |
| 4,280,058 | 7/1981 | Tar | 250/554 |
| 4,280,184 | 7/1981 | Weiner et al. | 364/506 |
| 4,328,527 | 5/1982 | Landis | 361/175 |
| 4,578,583 | 3/1986 | Ciammaichella et al. | 250/339 |
| 4,639,717 | 1/1987 | DeMeirsman | 340/578 |
| 4,736,105 | 4/1988 | Fonnesbeck | 250/372 |
| 5,023,456 | 6/1991 | Claussen | 250/372 |

*Primary Examiner*—David C. Nelms
*Assistant Examiner*—K. Shami
*Attorney, Agent, or Firm*—Edward Schwarz

[57] ABSTRACT

A driver circuit for an ultraviolet detector (UV) tube discriminates between firing of the UV tube in response to ultraviolet radiation impinging on it and a high resistance short between its output terminals. A capacitor charged on half cycles of AC power applied to the circuit discharges partially when the UV tube fires. This charge is transferred to a second capacitor to create a voltage displaced from ground. Each time the UV tube fires, the steep wave front generated thereby is passed by a high pass filter to a switch which momentarily grounds the voltage on the second capacitor through a resistor. The rapid change in the switch element's voltage signifies the presence of ultraviolet radiation on the UV tube.

12 Claims, 2 Drawing Sheets

CIRCUIT FOR DETECTING FIRING OF AN ULTRAVIOLET RADIATION DETECTOR TUBE

BACKGROUND OF THE INVENTION

State of the art controllers for fuel burners such as furnaces are now based on microprocessors which dramatically improve the control process. Nevertheless, it is still necessary to provide information as to the current operating state of the fuel burner. Among the most important of the state parameters is whether there is flame in the burner. The continued supply of fuel to the burner must be conditioned on the presence of flame, since if flame is not present and fuel is allowed to flow to the burner, the accumulation resulting can explode or asphyxiate, either one a potentially lethal event. Accordingly, it has been recognized for a long time in burner control technology that detection of flame is of paramount importance.

There are basically three kinds of flame detector elements. Perhaps the most common is the so-called flame rod, which forms with the burner metal a sort of diode element when flame is present arising from the difference in the size of the flame rod compared to the burner itself. An AC potential applied between the flame rod and the burner metal causes DC current to be carried by the ionized particles generated by presence of a flame. By detecting presence of this DC current flow, it is possible to determine presence of flame. Because of the difference in sizes of the flame rod and the burner, the current flow is from the flame rod to the burner, meaning that presence of flame is signified by current flow into the flame rod signal conductor, placing its potential below ground voltage as represented by the burner.

A second type of flame detector is sensitive to infrared radiation, and produces a signal indicating flame when such radiation is present. A third type, and the one with which the invention to be described deals, produces an output when ultraviolet radiation produced by a flame impinges on an ultraviolet detector tube whose impedance drops suddenly in response to the radiation. Each of these sensors produces an output requiring substantial processing by special circuitry before a signal indicating presence and absence of flame and which is suitable to be an input to a microprocessor is generated. The circuitry which converts the flame detector signal to a signal suitable for use by the controller is referred to as a flame amplifier and its output as a flame present signal, or more simply, a flame signal.

The flame amplifier for a UV tube must assure that the impedance change in the UV tube arises from presence of ultraviolet radiation impinging on the tube and not from a high resistance shunt across the tube terminals. An early circuit which discriminates between the sudden change of tube impedance arising from ultraviolet radiation and other types of impedance change between the tube terminals is described in U.S. Pat. No. 4,328,527 (Landis) and having a common assignee with this application.

A flame rod amplifier circuit designed to operate with a positive DC power supply adds a measure of reliability to its operation by interfacing with a flame rod sensor whose output is a negative current, i.e., one whose current flows into the sensor from the flame amplifier. The extra measure of reliability arises from the fact that any leakage current within the flame amplifier cannot masquerade as the negative current flow forming the flame rod output. Any leakage current in a flame amplifier powered by positive voltage will almost invariably be positive, and thus not likely to be interpreted as the negative flame rod sensor output. A pending US patent application which covers a flame amplifier circuit embodying these concepts is titled Fail-Safe Condition Sensing Circuit, has as an inventor Paul Sigafus, was filed on Sep. 30, 1991 with Ser. No. 07/783,950, and has a common assignee with this application.

The most efficient way to implement this flame rod amplifier is as a special purpose microcircuit. Because of this implementation, returns to scale are particularly high, meaning that the unit cost drops substantially with increases in the number of individual circuits produced. Accordingly, it is very advantageous for this flame rod amplifier to be compatible with not only the flame rod detector, but also with the UV and IR detectors. However, the power required to drive the UV and IR detectors is different from that required for flame rod detectors. Accordingly, it is not possible to simply replace the flame rod detector with a UV tube flame detector.

One embodiment of the invention to be described is its ability in one embodiment to interface the above-described flame rod amplifier to the standard UV flame detector tube. This interface circuit provides a flame detector signal when flame is present or absent based on presence of absence of UV radiation and which signal is nearly identical to the signal provided by the flame rod detector in similar circumstances.

BRIEF DESCRIPTION OF THE INVENTION

A driver circuit which uses a UV discharge tube (UV tube) having first and second terminals to reliably detects presence of flame is powered by an AC voltage source. The output of this circuit is a UV or flame signal varying with presence and absence of ultraviolet radiation impinging on the UV tube. The UV signal has a first predetermined form responsive to presence of ultraviolet radiation impinging on the UV tube and a second predetermined form responsive to absence of ultraviolet radiation impinging on the UV tube.

In its most basic form, the driver circuit includes a tube driver capacitor having a first terminal forming one connection for the AC voltage source, and a second terminal for connection, preferably through a resistor, to the first terminal of the UV tube. There is a tube driver diode having a first terminal connected to the second terminal of the tube driver capacitor and a second terminal. A tube driver resistor has a first terminal connected to the second terminal of the tube driver capacitor and a second terminal for connection to the second terminal of the UV tube and to the second terminal of the AC voltage source. An output driver capacitor is placed in parallel with the tube driver resistor. A high pass filter has an input terminal connected to the tube driver capacitor's second terminal, a common terminal connected to the UV tube's second terminal, and an output terminal. There is a switch element having a control terminal connected to the high pass filter's output terminal, a first power terminal, and a second power terminal connected to the UV tube's second terminal. Finally, there is an output driver resistor connecting the second terminal of the tube driver diode to the first power terminal of the switch element.

When the circuit is installed, a UV tube of predetermined characteristics is connected between the second terminal of the tube driver capacitor and the second terminal of the AC voltage source, and an AC voltage source of predetermined characteristics and compatible with the UV tube and circuit component characteristics is connected to the AC power terminals. Then when ultraviolet radiation impinges on the UV tube the UV signal having the first predetermined form is present at the first terminal of the switch element. At all other times the UV signal at the first terminal of the switch element has its second predetermined form.

It is usual that a pulse detector acting as a signal conditioner receives the UV signal from the switch element. The form of the UV signal is transformed by the pulse detector into one which is compatible with the circuitry downstream which for example, may control the operation of a burner. In one preferred embodiment, the UV signal is transformed into a low level current which simulates the current flow of a flame rod detector and its associated circuitry.

DESCRIPTION OF THE PREFERRED EMBODIMENTS

Figure 1:
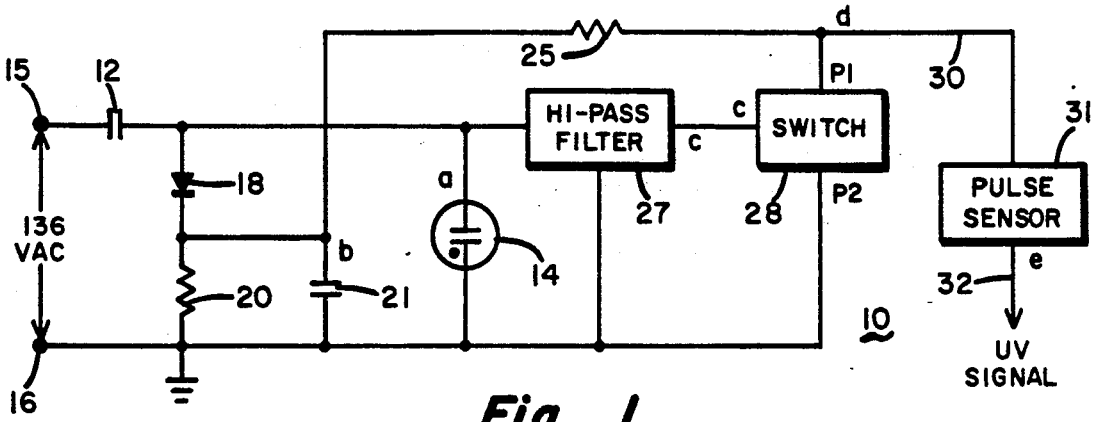
FIG. 1 is a circuit diagram showing a simplified form of the invention.
Figure 3:
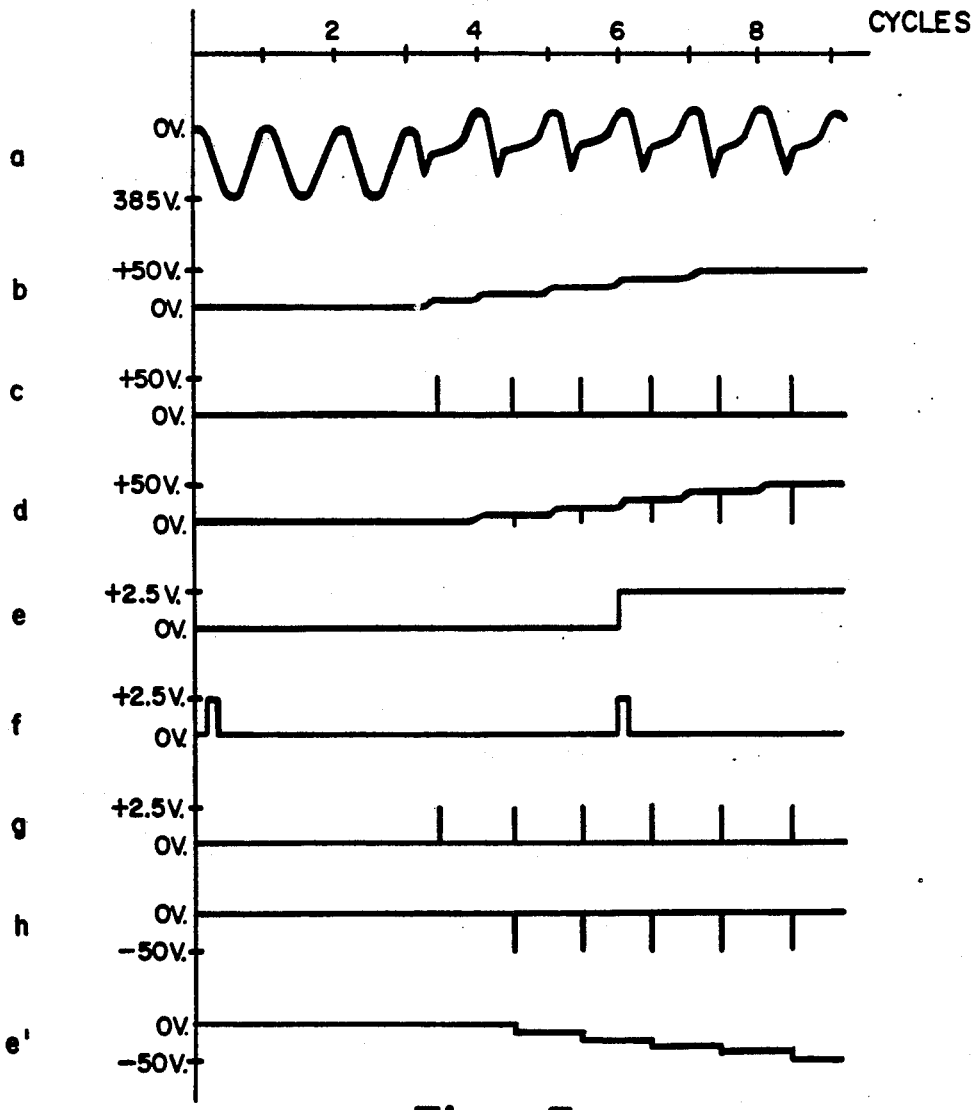
FIG. 3 shows a number of related waveforms useful in understanding the operation of FIGS. 1 and 2 and sharing a common time base.

Turning first to FIGS. 1 and 3, the simplified embodiment of the invention described therein discloses the essential features of the invention. In FIG. 1, a UV detector tube 14 of the discharge type is located to allow the ultraviolet radiation to be detected to impinge on it and in response the UV tube 14 by discharging changes impedance when a relatively large voltage is placed across its terminals. A discharge detection circuit 10 is used to operate the UV tube 14, and has power terminals 15 and 16 receiving 136 VAC 60 hz power from a transformer source for driving this circuit. A relatively large capacitor 12 whose value is preferably 2.2 μfd has one terminal connected to power terminal 15. The second terminal of capacitor 12 is connected to a first terminal of a tube driver diode 18, this first terminal comprising in this embodiment the anode. The second terminal of diode 18, shown as its cathode, is connected to a first terminal of a tube driver resistor 20. The second terminal of resistor 20 is connected to the second power terminal 16 and a second terminal of a UV tube 14. An output driver capacitor 21 is connected in parallel with resistor 20. UV tube 14 has its first terminal connected to the second terminal of capacitor 12. Power terminal 16 and the second terminal of UV tube 14 are both shown as grounded in FIG. 1. It is therefore convenient to reference other voltages to this ground potential of 0 v., and the waveforms of FIG. 3 are so referenced. The peak voltage of each waveform is shown on its own ordinate. The waveforms of FIG. 3 share the same time base. The reader should note that the actual voltage amplitudes shown in the waveforms of FIG. 3 are approximate and only suitable for explaining operation of the circuits of FIGS. 1, 2, and 4.

The voltage on the first terminal of UV tube 14 is shown as waveform a in FIG. 3, and its point of occurrence on FIG. 1 at point a. The voltage at point a is of course the voltage across UV tube 14. So long as there is no ultraviolet radiation impinging on UV tube 14, its impedance remains very high and voltage across tube 14 is not affected thereby. This condition is shown in the first three complete cycles of waveform a after steady state has been reached. It is assumed that ultraviolet radiation begins to fall on UV tube 14 between cycles 3 and 4.

Before ultraviolet radiation begins to impinge on UV tube 14, the AC power between terminals 15 and 16 is half wave rectified by diode 18, thereby causing capacitor 12 to charge to one-half the peak to peak voltage of the power wave. With the 136 VAC designation indicating the RMS value, this means that when steady state is reached as shown between cycles 0 and 3, capacitor 12 is charged to about 192 v., plus to minus from its first to second terminal. Once capacitor 12 is fully charged, the Voltage at point a varies from 0 to −385 v. as shown in FIG. 3, waveform a.

UV tube 14 in this embodiment conducts when the voltage across its terminals exceeds approximately 230 v., and once it starts conducting, has an internal voltage drop of around 180 v. UV tube 14 discharge is shown after cycle 3 in FIG. 3. In waveform a, voltage at point a falls from −230 v. to about −180 v. during each negative-going portion of the AC power wave. The charge on capacitor 12 of +192 v. is added to the voltage of the negative-going power wave to shift the voltage at point a to −230 v., causing UV tube 14 to fire. The voltage across it immediately drops to −180 v. or less as it begins to conduct. In the preferred embodiment of FIG. 4, an impedance in series with capacitor 12 and UV tube 14 is present to prevent excessive current flow through UV tube 14.

Conduction by UV tube 14 continues until the voltage at point a falls below some threshold value, at which time the voltage at point a assumes a sine wave shape again. The voltage at point a then rises above 0 v. in order to replace charge on capacitor 12 which was removed by current flow through UV tube 14. Part of this recharging current flows through resistor 20 and part of it flows through capacitor 21, thereby creating a charge and consequent voltage on capacitor 21 shown by waveform b. Over a period of several power cycles, a charge in the neighborhood of +50 v. forms at point b arising from the current flow through UV tube 14. However, the first time UV tube 14 discharges into conduction, there is no voltage on capacitor 21, and therefore the first discharge, during cycle 4, does not produce a corresponding negative-going voltage spike at point d. Subsequent negative-going spikes at point d become increasingly longer as the voltage on capacitor 21 increases.

The voltage at the first terminal of UV tube 14 is applied to the input terminal of a high pass filter 27 whose common terminal is connected to the second terminal of the UV tube 14. The output signal of high pass filter 27 is applied to the control (C) terminal of switch element 28. High pass filter 27 provides at its output terminal an output signal comprising only the steep wave front portions of the filter input signal, shown as the positive-going spikes in waveform c. Each time UV tube 14 begins to conduct, the voltage at point a rises very quickly and only this voltage change can pass through filter 27.

Figure 4:
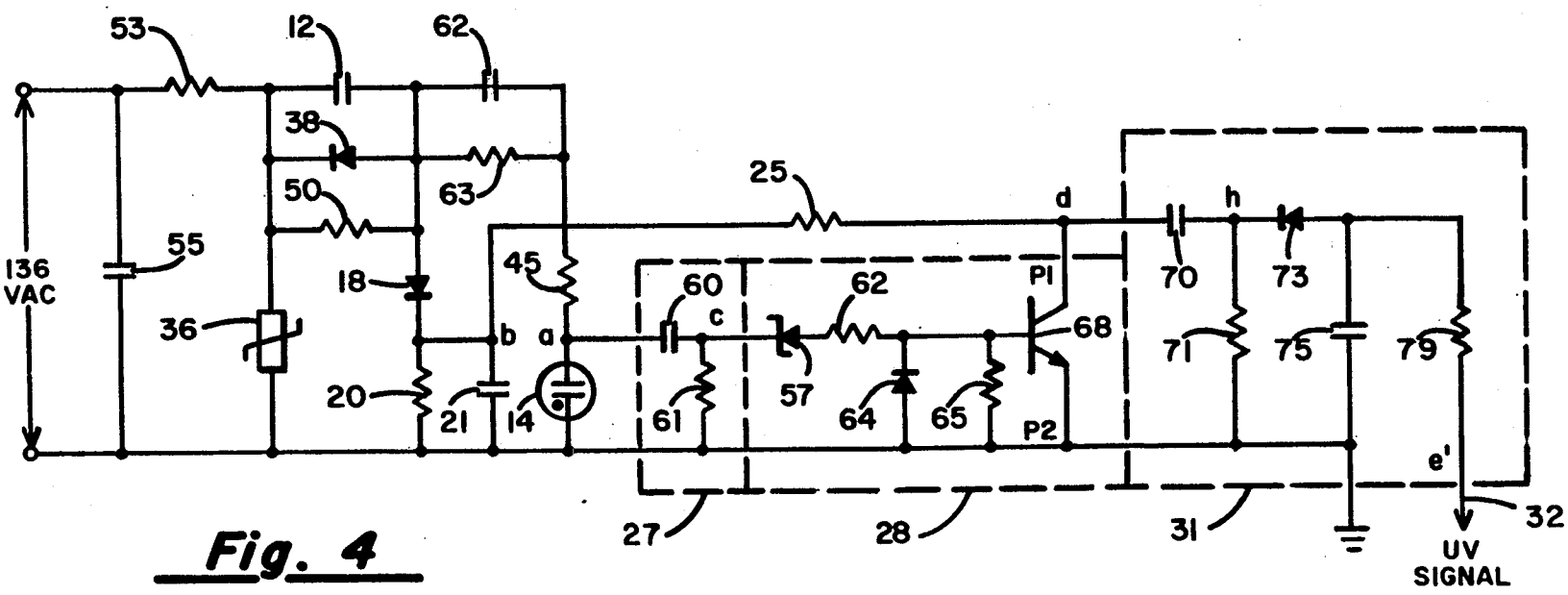
FIG. 4 is a circuit diagram showing the preferred embodiment of the invention.

Switch element 28 will typically include several components such as those shown in FIG. 4, but for purposes of explaining this simplified embodiment, is shown as a block element. Switch element 28 is defined as conducting from the Pl to the P2 power terminals when voltage at the C terminal rises above the ground voltage more than a few volts, and not conducting otherwise. The Pl power terminal of switch 28 is connected by an output driver resistor 25 to the first terminal of output driver capacitor 21. As explained above and shown in waveform b, once UV tube 14 begins to conduct, the voltage at point b begins to rise as part of the recharge current for capacitor 12 also flows into capacitor 21. Thus the voltage at point d, power terminal Pl, also begins to rise as shown in waveform d. Each time UV tube 14 begins to conduct, the steep wave fronts passed by high pass filter 27 momentarily drive switch 28 into conduction, causing the voltage at point d to fall to near 0 v. as is shown by the very narrow negative-going spikes of waveform d. After a few cycles of conduction by UV tube 14, a steady state voltage of around +50 v. at point b is reached, and each momentary conduction by switch 28 causes this voltage as shown at point d to fall to ground potential during switch 28 conduction. It can thus be seen that pulses as shown in waveform d can occur only if UV tube 14 is conducting o negative half cycles of the AC power, and there are steep wave front features in the voltage across UV tube 14. If there is no significant conduction by UV tube 14, capacitor 21 will not be charged and the voltage at point b will stay near 0 v. If there are no steep wave front features in the voltage across UV tube 14, then no negative-going pulses will appear at point d. Thus high resistance shunts across UV tube 14 will not be recognized as indicating presence of ultraviolet radiation.

A pulse sensor circuit 31 is connected by a path 30 to the Pl power terminal of switch 28. Pulse sensor circuit 31 counts the number of pulses in a fixed interval or otherwise detects or processes these pulses, to thereby indicate that ultraviolet radiation is impinging on UV tube 14.

Figure 2:
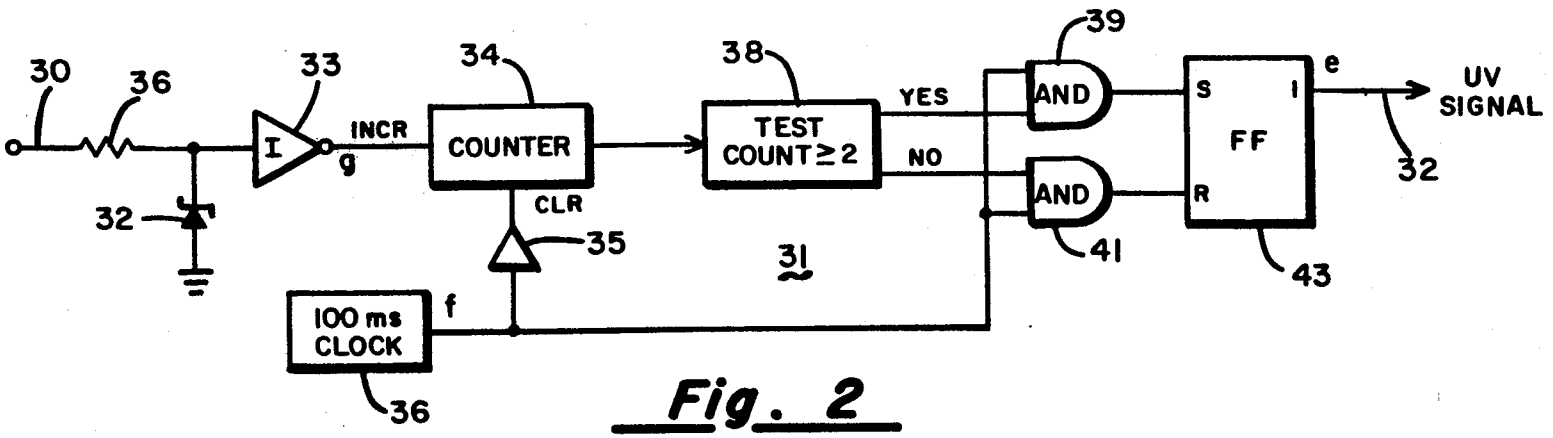
FIG. 2 is one form of a pulse detector compatible with the circuit of FIG. 1.

A particular type of pulse sensor circuit 31 is shown in FIG. 2. An inverter 33 receives the signal represented by waveform d and produces positive-going spikes at point g corresponding to the negative-going spikes of waveform d. Since all of the elements shown in FIG. 2 are logic level devices, it is necessary to hold the input voltage on path 30 from the analog components of pulse detection circuit 10 to a relatively low level, so a 5 volt zener diode 32 performs this function, holding voltage at path 3 to a maximum of +5 v. Resistor 36 limits flow of current from the pulse detection circuit 10 to the inverter 33.

A counter 34 receives the waveform g signal on an increment (INCR) input terminal from inverter 33. Counter 34 maintains an internal numeric count value which is incremented each time a positive spike occurs in waveform g. Each time a positive-going edge occurs on a clear (CLR) input terminal this internal count value is set to zero.

A 100 ms. clock element 36 produces a pulse at point f every 100 ms. as shown in waveform f. While this clock 36 is shown as issuing its pulses in phase with the power wave of waveform a and may even be derived from the power wave, this phase relationship is not necessary. The reader will understand that a 100 ms clock pulse occurs each sixth power cycle for the standard 60 hz. power waveform used here. Each clock pulse is applied to the clear (CLR) terminal of counter 34 through an amplifier 35 creating a short delay in the signal as applied to the CLR terminal. The internal value recorded in counter 34 is set to zero by each pulse issued by clock 36.

The internal value in counter 34 is made available for a test element 38 which sense whether the count value in counter 34 is two or greater, or less than two. If greater than or equal to two, a voltage signal encoding a logical 1 value is placed on the YES output terminal of element 38, and the NO output element carries a voltage signal encoding a logical 0. If the contents of test element 38 is 0 or 1, then these logical values on the YES and NO output terminals are reversed, with the YES terminal carrying a logical 0 and the NO terminal carrying a logical 1.

The YES and NO output signals from test element 38 are applied to input terminals of AND gates 39 and 41 respectively. Second input terminals of AND gates 39 and 41 each receive the clock signals from clock element 36. The output terminals of AND gates 39 and 41 are connected respectively to the set (S) and reset (R) terminals of a D flip-flop 43, whose "1" output terminal provides the UV signal on path 32 and as shown in FIG. 1.

Whenever two or more positive-going spikes are present in the output of inverter 33 within one 100 ms. interval, test element 38 senses that the contents of counter 34 are equal to or greater than 2, and a logical 1 is applied to the S input terminal of flip-flop 39 when the clock pulse defining the end of the 100 ms. interval occurs. The delay of amplifier 35 prevents clearing of counter 34 until the signals carried on the output terminals of test element 38 have been gated by AND gates 39 and 41 to flip-flop 43. So long as there are at least two discharges of UV tube 14 within each 100 ms. interval, it can be safely assumed that a flame is present and emitting ultraviolet radiation. It is obvious that different applications might require more discharges of UV tube 14 within a 100 ms. interval, and this can be easily made by simply changing the threshold of test element 38. Assuming that there had been no discharges of UV tube 14 for a period of time prior to their start in cycle 3, the output of flip-flop 43 shown as waveform e will encode a logical 0 value. When two positive-going spikes occur within the 100 ms. interval defined by power cycles 1 through 6, then the logical value encoded by the "1" output of flip-flop 43 changes from a logical 0 to a logical 1 within cycle 6 as shown in waveform e.

The circuit of FIG. 4 is an operational embodiment of this invention. It is quite similar in several respects to the circuit of FIG. 1, and for this reason the similar components and elements have been given similar reference numbers. Since the operation of much of these two circuits is similar, it is convenient to describe the purpose and function of only those elements of FIG. 4 not shown in FIG. 1. Capacitor 55, connected between the power terminals 15 and 16 removes high and mid-range frequency noise from the power wave. Voltage regulator 36 further limits the potential distortion in the power wave by limiting the maximum voltage difference between power terminals 15 and 16 to less than 270 v. Resistor 53 is in series with capacitor 12, and limits current flow through capacitor 12 and UV tube 14 to prevent complete discharge of capacitor 12 when tube 14 fires. Resistor 50 is connected in parallel with capacitor 12 and provides a high resistance shunt for bleeding dangerous voltage levels from capacitor 12 when the circuit is not in use. Diode 38 also shunts capacitor 12, and its polarity is such that capacitor 12 cannot charge negative to positive from left to right. If capacitor 12 is chosen as being of a polarized type, it is thus protected from damage arising from charging in the wrong direction.

Capacitor 60 and resistor 61 form high pass filter 27 as shown, capacitor 60 having a value of around 500 pfd. so as to substantially attenuate all except very steep voltage changes across UV tube 14. Within switch element 28, zener diode 57 drops the voltage provided by the output of high pass filter 28 by a fixed amount. Resistors 62 and 65 divide the voltage dropped by zener diode 57 to provide a level for driving into conduction at the proper time the transistor 68 which performs the actual switching function within switch element 28. Diode 64 prevents damage arising from the voltage on the base of transistor 68 from falling more than one diode drop below the emitter. The emitter and collector of transistor 68 respectively form power terminals P1 and P2 as shown.

The circuit of FIG. 4 embodies a pulse sensor 31 which does not provide a direct logic signal indicating the presence o absence of ultraviolet radiation impinging on UV tube 14. Instead, the pulse sensor 31 of FIG. 4 comprises an analog converter which mimics the output of a flame rod detector. The voltage on capacitor 21 is applied to a capacitor 70 through resistor 25, causing capacitor 70 to charge through resistor 71 to a voltage level near that of capacitor 21. The reader will see that capacitor 70 is thereby charged positive to negative from left to right. The value of capacitor 70 is selected to be approximately an order of magnitude smaller than is capacitor 21 so that the amount of charge held by capacitor 70 is much smaller than that held by capacitor 21. Each negative-going spike at point d of FIG. 4 pulls the left terminal of capacitor 70 to ground, and for the duration of the spike driving the voltage at the connection point h to a negative level whose absolute value equals the value of the positive voltage carried on capacitor 21 at point b.

A sample and hold circuit comprises a sampling diode 73, sampling capacitor 75, and sampling resistor 79. Diode 70 has its cathode connected to point h, the right terminal of capacitor 70. The anode of diode 73 is connected to a first terminal of sampling capacitor 75 with the second terminal of capacitor 75 connected to ground. Sampling resistor is connected between ground and the anode of diode 73. Each time point d is pulled to ground, the voltage at point h is pulled down to a negative voltage equal to the voltage across capacitor 70, as is shown by the negative-going spikes in waveform h of FIG. 3. The value of capacitor 75 is roughly an order of magnitude smaller than the value of capacitor 70. Each time a negative-going spike in waveform h occurs, a portion of the charge on capacitor 70 is transferred to capacitor 75 as is shown by the negative-going transitions in waveform e' in FIG. 3. Once the voltage at point h returns to near ground, diode 73 cuts off preventing the voltage at point h from affecting the activity of diode 75 and resistor 79. The charge placed on capacitor 75 each time point h is pulled negative then creates a current flow through resistor 79 when a high impedance usage device is attached to terminal 32. A UV signal current flows into terminal 32 through the usage device and produces a negative UV signal voltage at terminal 32 shown as waveform e'. The charge on capacitor 73 slowly dissipates through resistor 79 and the usage device as is shown by the slowly rising voltage in waveform e' between the successive instants capacitor 75 receives charge from capacitor 70. By proper choice of the various components in the circuit of FIG. 4, the current flow into terminal 32 will be very similar to that characteristic of a flame rod sensor.

In my preferred embodiment, the various components of FIG. 4 have the values shown in the following table:

| | |
|---|---|
| Resistor 53 | 910o |
| Capacitor 55 | .0022 μfd. |
| Capacitor 12 | 2.2 μfd. |
| Diode 38 | type 1N4004 |
| Resistor 50 | 100 mego |
| Diode 18 | type 1N3195 |
| Capacitor 62 | 4.7 μfd. |
| Resistors 63, 67, and 71 | 10,000o |
| Resistor 20 | 8,200o |
| Capacitor 21 | 4.7 μfd. |
| Resistors 45 and 71 | 1,000o |
| Capacitor 60 | 500 pfd. |
| Resistor 61 | 51,000o |
| Zener diode 57 | 10 v. |
| Diodes 64 and 73 | type 1N4148 |
| Resistor 65 | 200,000o |
| Transistor 68 | type MPS8099 |
| Capacitor 70 | .47 μfd. |
| Capacitor 75 | .033 μfd. |
| Resistor 79 | 2.94 mego |

The preceding has described my invention; what I wish to protect and claim by letters patent is:

1. A UV tube driver circuit powered by an AC voltage source, for providing a UV signal varying with presence and absence of ultraviolet radiation impinging on a UV discharge tube having first and second terminals, said UV signal having a first predetermined form responsive to presence of ultraviolet radiation impinging on the UV tube and a second predetermined form responsive to absence of ultraviolet radiation impinging on the UV tube, comprising a) a tube driver capacitor having a first terminal forming one connection for the AC voltage source, and a second terminal for connection to the first terminal of the UV tube;

b) a tube driver diode having a first terminal connected to the second terminal of the tube driver capacitor and a second terminal;

c) a tube driver resistor having a first terminal connected to the second terminal of the tube driver diode and a second terminal for connection to the second terminal of the UV tube and to the second terminal of the AC voltage source;

d) an output driver capacitor in parallel with the tube driver resistor;

e) a high pass filter having an input terminal connected to the tube driver capacitor's second terminal, a common terminal connected to the UV tube's second terminal, and an output terminal;

f) a switch element having a control terminal connected to the high pass filter's output terminal, a first power terminal, and a second power terminal connected to the UV tube's second terminal; and g) an output driver resistor connecting the second terminal of the tube driver diode to the first power terminal of the switch element, wherein when a UV tube having ultraviolet radiation impinging on it is connected between the second terminal of the tube driver capacitor and the second terminal of the AC voltage source and an AC voltage source of predetermined characteristics is connected to the AC power terminals, the UV signal with the first predetermined form is present at the first power terminal of the switch element.

2. The tube driver circuit of claim 1, and further including a pulse sensor connected to the switch element first power terminal.

3. The tube driver circuit of claim 2, wherein the pulse sensor comprises a timer providing first and second clock pulses separated by a predetermined time interval, and a pulse counter receiving the UV signal and cumulating pulses between the first and second clock pulses.

4. The tube driver circuit of claim 2, wherein the pulse sensor comprises an integrator circuit having an input terminal connected to the switch element's first power terminal and an output terminal providing the UV signal.

5. The tube driver circuit of claim 2, wherein the pulse sensor includes a sensor capacitor having a first terminal connected to the first power terminal of the switch element and a second terminal;

a resistor connecting the sensor capacitor's second terminal and the UV tube's second terminal; and a sample and hold circuit having an input terminal storing the sensor capacitor voltage each time the switch element conducts between its power terminals, a common terminal connected to the UV tube's second terminal and an output terminal providing the UV signal.

6. The tube driver circuit of claim 5, wherein the sample and hold circuit comprises a sampling diode having second terminal comprising the first terminal of the sample and hold circuit and a first terminal;

a sampling capacitor having a first terminal connected to the first terminal of the sampling diode and a second terminal forming the common terminal of the sample and hold circuit; and a sampling resistor having a first terminal connected to the first terminal of the sampling diode and a second terminal forming the output terminal of the sample and hold circuit.

7. The tube driver circuit of claim 6, wherein the tube driver and sampling diodes' first terminals are each anodes, and the anode of the UV tube forms the second terminal thereof.

8. The tube driver circuit of claim 6, wherein the high pass filter comprises a high pass capacitor connected between the input and output terminals of the high pass filter and a resistor connected between the output and common terminals, and the sensor capacitor has a value at least an order of magnitude greater than the value of the high pass capacitor.

9. The tube driver circuit of claim 6, wherein the sensor capacitor has a value approximately an order of magnitude greater than the value of the sampling capacitor.

10. The tube driver circuit of claim 1, wherein the tube driver diode's first terminal is the anode, and the anode of the UV tube is connected to the second terminal of the driver diode.

11. The tube driver circuit of claim 1, wherein the tube driver capacitor and the output driver capacitor values are of approximately the same magnitude.

12. The tube driver circuit of claim 1, wherein the switching element comprises a switch resistor having a first terminal forming the control terminal of the switch element and a second terminal; and a transistor having a base terminal connected to the switching resistor's second terminal and power terminals comprising the power terminals of the switch element.

* * * * *